United States Patent [19]

Browne

[11] 4,047,615

[45] Sept. 13, 1977

[54] MODULAR MERCHANDISING

[76] Inventor: Peter Browne, 27 Maughan Road, Baie D'urfe, Quebec, Canada, H9X 3E1

[21] Appl. No.: 628,969

[22] Filed: Nov. 5, 1975

[30] Foreign Application Priority Data

Aug. 8, 1975 United Kingdom ..... 33237/75

[51] Int. Cl.[2] ..... A47F 5/12

[52] U.S. Cl. ..... 211/88; 211/164; 248/202

[58] Field of Search ..... 211/88, 90, 150, 81, 211/91, 164, 84, 170, 163, 173; 248/DIG. 3, 202, 133–139; 312/123, 248, 198, 327, 120, 136, 328

[56] References Cited

U.S. PATENT DOCUMENTS

| | | | |
|---|---|---|---|
| 367,789 | 8/1887 | Cutler | 312/248 |
| 512,420 | 1/1894 | Willits | 248/137 X |
| 619,190 | 2/1899 | Knappenburger | 312/120 |
| 762,888 | 6/1904 | Decker | 312/123 |
| 2,326,710 | 8/1943 | Waycott, Sr. | 211/81 |
| 2,400,807 | 5/1946 | Burkhard | 248/DIG. 3 |
| 2,785,036 | 3/1957 | Elsden-King et al. | 312/327 |
| 3,289,994 | 12/1966 | Burmeister | 248/DIG. 3 |
| 3,438,644 | 4/1969 | McMillan et al. | 248/202 X |
| 3,669,395 | 6/1972 | Gehrke | 211/90 X |
| 3,799,466 | 3/1974 | Adams | 248/DIG. 3 |
| 3,942,851 | 3/1976 | Kaplan | 248/133 X |

FOREIGN PATENT DOCUMENTS

| | | | |
|---|---|---|---|
| 963,877 | 3/1975 | Canada | 248/DIG. 3 |

*Primary Examiner*—Roy D. Frazier
*Assistant Examiner*—Terrell P. Lewis

[57] ABSTRACT

An improved merchandising unit which facilitates the removal of stock therefrom while providing a more efficient utilization of the display area available in a store than can be achieved with conventional shelving units. According to the present invention, there is provided an improved merchandising unit comprising a shelving unit; means situated on either end of such shelving unit, said means engaging cooperating means located on a pair of support brackets, the support brackets adapted to pivotally support the shelving unit from a support structure, said shelving unit having an open portion. The shelving unit is pivotable between a rest position and a tilted position, the tilted position adapted to provide access to the open portion, thereby facilitating insertion and removal of items from the shelving unit.

5 Claims, 2 Drawing Figures

MODULAR MERCHANDISING

BACKGROUND OF THE INVENTION

1. Field of the Invention

The present invention relates to an improved modular merchandising unit.

2. Description of the Prior Art

When considering the available display and sales area within a store, it should be noted that, both in Canada and the United States, height limitations are imposed on stock shelving, thereby limiting the area of stock shelving which can be utilized within a store. For this reason, the most efficient use of this space must be found in order to increase the number of items per square foot of display area within the store.

Known merchandising units for displaying items which are similar to the present invention utilize bins which are located, one above the other, in fixed positions. The use of such arrangements necessitates the leaving of sufficient space between adjacent bins to permit access thereto by a purchaser. This space, however, is essentially wasted since it cannot be utilized for storing or displaying merchandise. Additionally, when using stationary bins, it is more difficult to replenish the bins with stock, as well as rendering removal of stock from the bins more difficult, especially when the supply of stock in the bin becomes low.

The present invention proposes to improve the utilization of otherwise wasted space between adjacent shelves, thereby increasing the amount of stock contained in the merchandiser per square foot of display area. At the same time, the proposed invention further facilitates the removal of stock from the merchandiser by the customer, as well as permitting the merchandiser to be more readily filled with stock.

The present invvention further minimizes the mixing up of stock by customers since the customers would hold the unit open while examining an item and would therefore be able to determine from which bin the item was removed, thereby facilitating replacement of the item in its correct bin. In addition, the item display area, rather than being situated in a substantially vertical plane as in known merchandisers, is situated at an angle to permit easy selection of the desired item, even when the purchaser is standing close to the merchandiser. Additionally, the smooth surface of the improved merchandiser facilitates wiping in order to remove dust therefrom, as well as providing an appearance which would have customer appeal.

The improved merchandiser according to the present invention can be mounted on a pegboard, from a wall, or even from any suitable structure such as a free-standing support. In the case of a free-standing support structure, it would be possible to have access to the merchandiser from either side of the stand, thereby further increasing the effective sales area within a store. In this regard, the improved merchandiser according to the present invention is substantially narrower than known similar merchandisers, such that the floor area space necessary for the improved merchandiser is less than when utilizing existing merchandisers.

SUMMARY OF THE INVENTION

In order to achieve the above advantages, the present invention proposes the use of an improved merchandising unit comprising a shelving unit; means situated on either end of such shelving unit, said means engaging co-operating means located on a pair of support brackets, the support brackets adapted to pivotally support the shelving unit from a support structure. The shelving unit has an open portion; and the shelving unit is pivotable between a rest position and a tilted position, the tilted position adapted to provide access to the open position, thereby facilitating insertion and removal of items from the shelving unit.

BRIEF DESCRIPTION OF THE DRAWINGS

In a drawing which illustrates one embodiment of the present invention.

DESCRIPTION OF THE PREFERRED EMBODIMENTS

Figure 1:
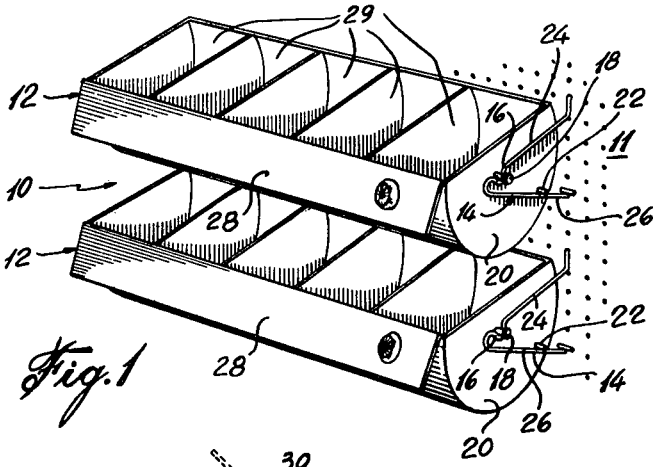
FIG. 1 is a perspective unit illustrating two shelving units of the modular merchandising unit.

In the drawing, the improved merchandiser unit is indicated generally by reference numeral 10. The unit 10 includes a number of individual shelving units 12 which are supported substantially vertically from a pegboard 11. Each shelving unit 12 is supported at opposite ends by a pair of support brackets 14 which support the individual shelving units 12 from the pegboard 11, or other suitable support structure. An upper arm of each bracket 14 includes a U-shaped portion 16 which receives a cooperating mounting pin 18 situated on each end wall 20 of each shelving unit 12. The end wall 20 also supports a stop member 22 mounted thereon which engages upper and lower arms 24 and 26, respectively, of the bracket 14. As a result, pivotal movement of the shelving unit 12 about the mounting pins 18 is limited by engagement of the stop member 22 with the arms 24 and 26. In this way, accidental spillage of items from the shelving unit 12 due to excessive tilting thereof by a user is prevented. The mounting pins 18 are so located on the ends wall 20 as to be offset from the centre of gravity of the shelving units 12. As a result, each shelving unit 12 automatically returns from its tilted position after being released by a user by pivoting clockwise about its mounting pins 18. The amount of clockwise rotational movement is limited by engagement of stop member 22 with arm 26.

Figure 2:
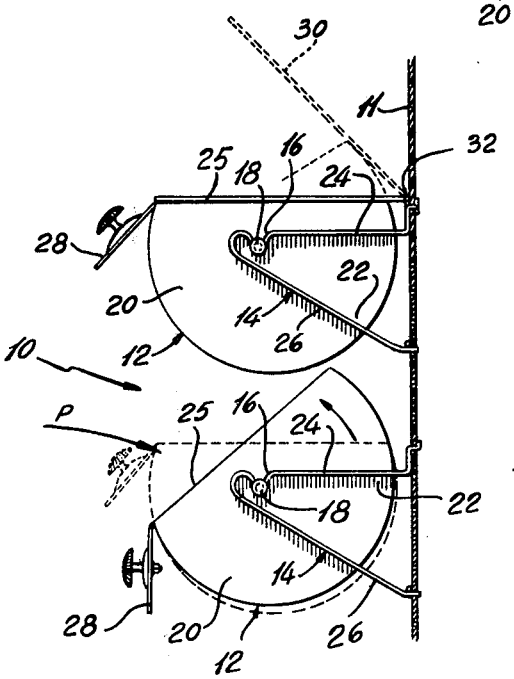
FIG. 2 is a side view of two shelving units illustrating the manner of operation thereof.

The outer configuration of each shelving unit 12 forms the segment of a circle with the mounting pins 18 being situated away from the centre of the circle in order to permit return of the shelving unit to a rest position with the top 25 thereof being situated substantially horizontally. The round configuration of the shelving units 12 permits maximum utilization of space in a vertical direction. In particular, as shown in FIG. 2, when one of the shelving units 12 is tilted by the application of pressure to the front portion thereof, as indicated by arrow P, the unit pivots counter-clockwise about its mounting pins 18. The rear edge of the top of the shelving unit does not engage the lower surface of the vertically adjacent upper unit since the lower surface of the upper unit 12 is rounded. As well, if the shelving unit had a rectangular, as opposed to a around configuration, the rear surface of the shelving unit would have to be located farther from the pegboard to prevent the lower rear corner of the unit from engaging the pegboard as the unit is being tilted. In addition, the rounded front surface of the upper unit permits easy access to the contents of the shelving unit 12 situated beneath it. As a result, vertically adjacent shelving units 12 can be spaced closer together without restricting access to the units and without interference of the units during pivotal movement thereof in order to expose the contents of the shelving units.

The forward edge of each shelving unit 12 supports an outwardly and downwardly directed surface 28 which provides a display area for pictures or samples of the products contained in individual bins 29 located within the shelving unit. The configuration of the shelving units is such as to permit more merchandise to be stored in each bin 29, as well as permitting the utilization of narrower bins than in conventional merchandising units. Indeed, in stationary units, wider bins are necessary in order to facilitate access thereto by a purchaser. Additionally, the curved upper surface of the merchandising unit according to the present invention effectively retains items within each shelving unit 12.

The shelving units 12 may be made of metal or from a suitable plastic. The rounded surfaces of the shelves further facilitate cleaning thereof and minimize the accumulation of dust thereon.

Since the shelving units 12 are tiltable, the contents contained in each bin become visible to the purchaser. Additionally, the tilted display surfaces 28 permit the purchaser to ascertain the contents of each bin even when standing close to the modular merchandiser 10. The shelving units 12 can be supported from a pegboard or wall, or can be supported from a free-standing support structure. In the latter case, the tilting of the shelving units permits access from either side, thereby increasing the accessibility to the modular merchandiser. In this latter case, the bracket structure for the shelving units are modified in order to permit access to the shelving units from either side.

By utilizing the shelving unit construction according to the present invention, the load supported by the brackets can be located closer to the support structure 11, the weight of the shelving unit being concentrated at the U-shaped portions 16 of the brackets 14. Since the bins of the shelving units are deeper and narrower than conventional shelving units, this being possible because the bins are readily accessible due to the tilting action, the centre of gravity of the shelving units and their contents is closer to the support structure than in the case of shelving units which are shallower and wider. As a result, the forces transferred by the brackets to the pegboard in the case of the present invention would normally be less, thereby permitting larger quantities of items to be contained in the shelving units according to the present invention without adversely affecting the support structure which might otherwise tend to become distorted if the same amount of stock were placed in a conventional shelving unit.

As a further feature of the present invention, a cover 30 connected to a support structure by a hinge 32 can be provided for each shelving unit. As the shelving unit is being tilted the cover 30 pivots upwardly, about its hinge 32, thereby exposing the contents of the shelving unit. Additionally, when mounting pins 18 are situated at or near the centre of gravity of the shelving units 12, the weight of the hinged cover 30 urges the shelving unit 12 back to its rest position. As a result, the cover 30 makes it unnecessary to offset the mounting pins 10 located on the ends of the shelving unit since the cover 30 assists in automatically returning the shelving unit 12 to its rest position. Where it is desired to minimize the space between vertically adjacent shelving units, only the top unit can be provided with such a hinged cover.

I claim:

1. An improved merchandising unit comprising a shelving unit having opposed parallel end walls and a continuous outer wall which is substantially semi-cylindrical in configuration extending between outer edges of the end walls, upper edges of the end walls and continuous outer wall defining an open portion which lies in a substantially horizontal plane when the shelving unit is in an initial position, the end walls having trunnions mounted thereon, the trunnions pivotally supporting the shelving unit from a pair of cooperating support brackets mounted on a wall situated rearwardly of the shelving unit such that a longitudinal axis of the shelving unit is substantially horizontal, the trunnions permitting the shelving unit to be normally displaced from its initial position when a user removes items from the shelving unit, whereby the open portion assumes a position extending downwardly toward the user, thereby providing easier access to the shelving unit to facilitate insertion and removal of items from the shelving unit; the trunnions being offset from a centre of gravity of the shelving unit such that when the shelving unit is displaced from its initial position by a user, the shelving unit automatically returns to the initial position upon being released by the user;

means provided on at least one end wall cooperating with the adjacent support bracket to limit the amount of the tilting of the shelving unit between the initial position and the tilted position thereby prevent accidental spillage of contents situated within the shelving unit;

the semi-cylindrical configuration of the continuous outer wall permitting the mounting of the shelving unit with a rear portion thereof closely adjcent a vertical wall, the shelving unit being freely pivotable between its initial and tilted position without any portion thereof engaging said wall.

2. An improved merchandising unit as claimed in claim 1, wherein said wall situated rearwardly of the shelving unit comprises a vertical pegboard and the support brackets being releasably secured to the pegboard, each support bracket having an upper arm and a lower arm, one end of each arm engaging the pegboard, each upper arm having a U-shaped bend adjacent a location where the upper and lower arms meet, the U-shaped bends receiving the trunnions therein, whereby the bracekts pivotally support the shelving unit from the pegboard.

3. An improved shelving unit according to claim 1, wherein the open portion of said shelving unit is provided with a cover structure, said cover structure being pivotally connected to the support structure whereby said cover structure is pivoted to an open position by the shelving unit as the shelving unit is advanced from its initial position to its tilted position, the open position of the cover structure permitting access to the open portion of the shelving unit.

4. An improved merchandiser according to claim 1, wherein said means for limiting pivotal movement of said shelving unit comprises a pin situated on at least one end wall of the shelving unit and extending outwardly therefrom, the pin adapted to engage spaced-apart arms of said adjacent support bracket, thereby limiting pivotal movement of the shelving unit between the said arms.

5. An improved merchandiser according to claim 4, wherein the shelving unit includes a display panel located along a forward edge of the continuous outer wall, the display panel adapted to permit mounting of samples or pictures of items contained within the shelving unit.

* * * * *

UNITED STATES PATENT AND TRADEMARK OFFICE

CERTIFICATE OF CORRECTION

PATENT NO. : 4,047,615

DATED : September 13, 1977

INVENTOR(S) : Peter Browne

It is certified that error appears in the above-identified patent and that said Letters Patent are hereby corrected as shown below:

[54] MODULAR MERCHANDISING UNIT

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*